US007399236B2

(12) United States Patent
Takeuchi

(10) Patent No.: US 7,399,236 B2
(45) Date of Patent: Jul. 15, 2008

(54) GOLF CLUB GRIP AND GOLF CLUB USING THE SAME

(75) Inventor: Hiroyuki Takeuchi, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/429,240

(22) Filed: May 8, 2006

(65) Prior Publication Data

US 2006/0270488 A1 Nov. 30, 2006

(30) Foreign Application Priority Data

May 24, 2005 (JP) ..... 2005-150534

(51) Int. Cl.
*A63B 53/14* (2006.01)

(52) U.S. Cl. ..... 473/300; 473/318

(58) Field of Classification Search ..... 473/318, 473/523, 297–299, 300
See application file for complete search history.

(56) References Cited

U.S. PATENT DOCUMENTS 2,250,429 A * 7/1941 Vickery ..... 473/323
2,782,035 A * 2/1957 East ..... 473/297
5,362,046 A * 11/1994 Sims ..... 473/300
5,704,259 A * 1/1998 Riehle ..... 81/22
5,772,541 A * 6/1998 Buiatti ..... 473/520
5,902,656 A * 5/1999 Hwang ..... 428/36.91
6,354,958 B1 * 3/2002 Meyer ..... 473/297
2003/0022729 A1 * 1/2003 Pergande et al. ..... 473/332
2003/0148820 A1 8/2003 Kumamoto
2005/0192116 A1 * 9/2005 Imamoto ..... 473/329

FOREIGN PATENT DOCUMENTS

JP 6-339551 A 12/1994

* cited by examiner

*Primary Examiner*—Stephen Blau
(74) *Attorney, Agent, or Firm*—Birch, Stewart, Kolasch & Birch, LLP

(57) ABSTRACT

A golf club grip includes: a grip body including a grip cylinder portion and a grip end portion disposed at one end of the grip cylinder portion and formed with a through-hole for communicating a grip interior with the outside; and a vibration absorption member formed from a viscoelastic material and formed separately from the grip body. The vibration absorption member is removably attached to the grip body. The vibration absorption member includes: a plane portion and a bar-like portion formed integrally with the plane portion. The bar-like portion extends through the through-hole of the grip end portion as projecting inwardly of the grip cylinder portion.

12 Claims, 8 Drawing Sheets

GOLF CLUB GRIP AND GOLF CLUB USING THE SAME

BACKGROUND OF THE INVENTION

The present invention relates to a golf club grip and a golf club using the same.

In order to increase head speed during swing, the recent golf clubs are reduced in weight by forming lightweight shafts and heads. In particular, the shafts are reduced in weight by using carbon fiber reinforced resin or the like.

Unfortunately, as the clubs are reduced more in weight, it is more likely that players experience uncomfortable vibrations or impact shock upon club-on-ball impact. If the shaft weight is reduced, in particular, shaft vibrations at club-on-ball impact are increased in frequency. The increased frequency deviates from the vibration frequency of the conventional shaft and hence, the uncomfortable vibrations or impact shock for the player tend to increase.

Heretofore, a variety of proposals have been made to suppress the vibrations produced at impact with ball.

For example, there is proposed a golf club which is designed to suppress the shaft vibrations by way of a metal weight supported on an inside surface of a shaft end portion via a viscoelastic material, a grip being attached to the shaft end portion (Japanese Unexamined Patent Publication No. 339551/1994). In another proposed golf club, a viscoelastic material having a loss tangent (tan δ) of 0.7 or more and formed into a bar shape is inserted in the shaft in contacting relation with the inside surface of the shaft end portion (Japanese Unexamined Patent Publication No. 70944/2003).

In the golf club disclosed in Japanese Unexamined Patent Publication No. 339551/1994, however, the metal weight and the like are so heavy that the whole body of the golf club has a substantial weight. This is disadvantageous from the viewpoint of weight reduction. On the other hand, the golf club disclosed in Japanese Unexamined Patent Publication No. 70944/2003 may fail to exhibit an adequate effect to suppress some particular vibration (vibration in a particular direction or having a particular frequency) depending upon the position or area of a contact portion between the aforesaid viscoelastic bar inserted in the inside surface of the shaft and the inside surface of the shaft. In some cases, therefore, this golf club may also fail to provide a consistent vibration suppression effect.

Vibration absorption performance required of the club varies according to personal performance (head speed, swing type and such) of users (golfers) or according to the club specifications. Hence, it is desirable to obtain the vibration absorption performance adapted to each golfer or each club.

SUMMARY OF THE INVENTION

In view of the foregoing, the invention has been accomplished and has an object to provide a golf club grip which is capable of effectively suppressing the shaft vibrations without relying on substantial weight increase, thereby offering good hit feeling and which is adapted for adjustment of vibration absorption performance, as well as to provide a golf club using the same.

A golf club grip according to the present invention comprises: a grip body including a grip cylinder portion shaped like a cylinder and receiving one end of a cylindrical shaft therein, and a grip end portion disposed at one end of the grip cylinder portion and formed with a through-hole for communicating a grip interior with the outside; and a vibration absorption member formed from a viscoelastic material, formed separately from the grip body, and removably attached to the grip body, and is characterized in that the vibration absorption member includes a base portion and a projection formed integrally with the base portion, the projection extending through the through-hole of the grip end portion as projecting inwardly of the grip cylinder portion.

Such a constitution is adapted to enhance the vibration absorption performance at club-on-ball impact because the projection of the vibration absorption member formed from the viscoelastic material projects inwardly of the grip. In addition, the vibration absorption member is removably attachable to the grip body and hence, the vibration absorption performance or the weight of the grip may be adjusted by exchanging the vibration absorption members.

It is preferred that the vibration absorption member is removably attached to the grip body by way of fit-engagement with the grip body.

In this case, quite a simple constitution permits the vibration absorption member to be attached to or removed from the grip body.

It is preferred that the projection is shaped like a bar, having a complex elastic modulus of $2.0\times10^{7}$ dyn/cm$^2$ or more and $1.0\times10^{10}$ dyn/cm$^2$ or less as determined at temperature of 0 to 10° C. and at a frequency of 10 Hz, a mass of 0.7 g or more and 6 g or less, and a length of 8 mm or more and 40 mm or less.

The complex elastic modulus is limited to the above range for the following reasons. If the complex elastic modulus of the projection is less than $2.0\times10^{7}$ dyn/cm$^2$, the projection is too soft, involving fear that the golf club may become instable during swing motion or that the projection may vibrate excessively to cause echo sound. Furthermore, the vibration amplitude of the projection may not agree with a vibration frequency of the shaft. If the complex elastic modulus of the projection is more than $1.0\times10^{10}$ dyn/cm$^2$, the projection is too hard, involving fear that the vibration amplitude thereof may be decreased and may not agree with the vibration frequency of the shaft. Hence, the shaft vibrations may be more effectively suppressed by using the viscoelastic material having the complex elastic modulus in the above range for forming the projection.

The mass of the projection is limited to the above range for the following reasons. If the mass of the projection exceeds 6 g, the whole body of the golf club has such a great weight that the golf club may be decreased in manipulability. If the mass of the projection is less than 0.7 g, the projection may not be fully brought into resonant vibrations, thus failing to exhibit an adequate vibration absorption performance.

The length of the projection is limited to the above range for the following reasons. If the length of the projection is less than 8 mm, the projection may not be fully brought into the resonant vibrations, thus failing to exhibit the adequate vibration absorption performance. If the length of the projection exceeds 40 mm, the vibration amplitude of the projection is increased so much that the amplitude may not agree with the shaft frequency. In addition, the projection is more likely to contact an inside surface of the shaft, leading to an increased possibility of echo sound.

It is preferred that the vibration absorption member is formed from a viscoelastic material admixed with a powdery metal of high specific gravity of 7 or more.

Such a constitution permits the vibration absorption member to be downsized. Hence, the vibration absorption member is prevented from projecting excessively outwardly of the grip body. Furthermore, the degree of freedom of designing the grip body and the shaft may be increased. What is more, it is easy for the projection to provide the adequate vibration absorption performance, even if the sectional area of the projection is made small. This makes it easy for the projection to provide a consistent vibration absorption performance as prevented from contacting the inside surface of the shaft. This also leads to an increased degree of freedom of designing the grip body (the grip cylinder portion, in particular) and the shaft thickness.

A golf club according to the invention comprises: a grip body including a cylindrical grip cylinder portion, and a grip end portion disposed at one end of the grip cylinder portion and formed with a through-hole for communicating a grip interior with the outside; a vibration absorption member formed from a viscoelastic material, formed separately from the grip body and removably attached to the grip body; a cylindrical shaft having one end inserted in the grip cylinder portion; and a golf club head attached to the other end of the shaft, and is characterized in that the vibration absorption member includes a base portion and a projection formed integrally with the base portion, the projection extending through the through-hole of the grip end portion as projecting inwardly of the shaft without contacting an inside surface of the shaft.

Such a constitution is adapted to enhance the vibration absorption performance at club-on-ball impact because the projection of the vibration absorption member formed from the viscoelastic material projects inwardly of the shaft without contacting the inside surface of the shaft. In addition, the vibration absorption member is removably attachable to the grip body and hence, the vibration absorption performance or the weight of the golf club may be adjusted by exchanging the vibration absorption members.

DETAILED DESCRIPTION

Preferred embodiments of the present invention will hereinbelow be described with reference to the accompanying drawings.

Figure 1:
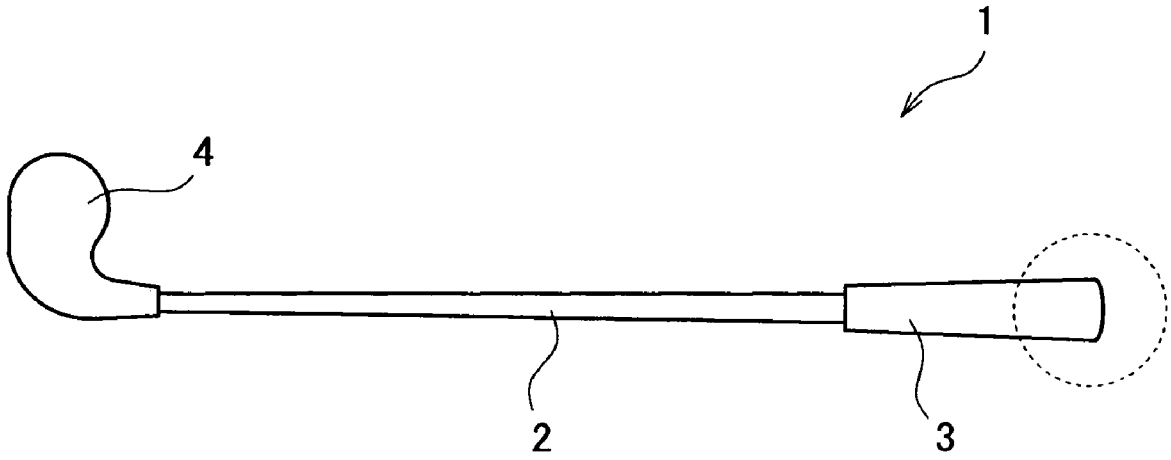
FIG. 1 is an outside view of a golf club assembled with a golf club grip according to a first embodiment of the present invention.

FIG. 1 is a schematic diagram showing a golf club 1 according to one embodiment of the present invention. The golf club 1 includes: a bar-like shaft 2; a golf club grip 3 (hereinafter, simply referred to as "grip") attached to one end of the shaft 2; and a head 4 attached to the other end of the shaft 2. The shaft 2 is a hollow cylindrical member. For clarity sake, a radial direction of the shaft 2 will be hereinafter referred to simply as "radial direction", a circumferential direction of the shaft 2 will be hereinafter referred to simply as "circumferential direction", and an axial direction of the shaft 2 will be hereinafter referred to simply as "axial direction".

Figure 2A:
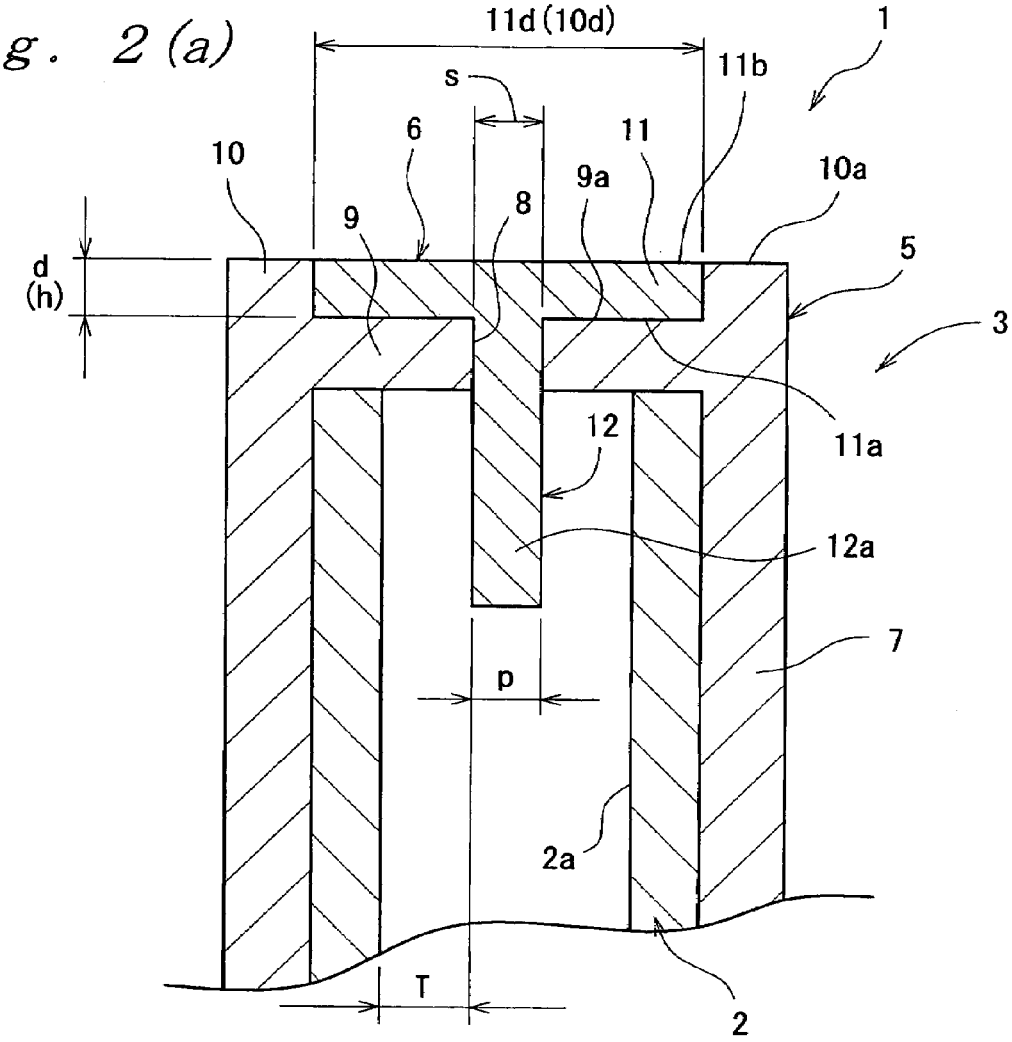
FIG. 2(*a*) is a sectional view of a portion enclosed in a dot circle in FIG. 1, whereas FIG. 2(*b*) is an outside view of the grip as seen from a grip end.
Figure 2B:
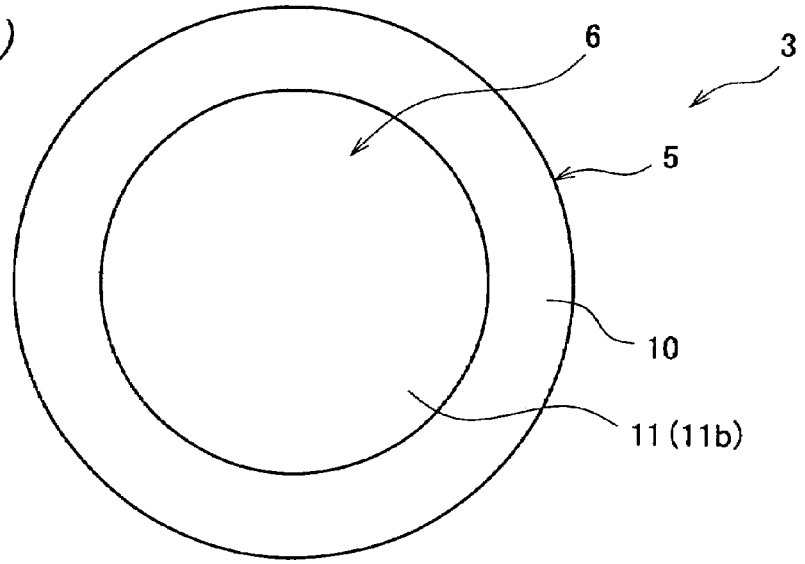

FIG. 2(*a*) is a sectional view showing a portion near a grip end (enclosed in a dot circle in FIG. 1) of the golf club 1. FIG. 2(*b*) is a view of the grip 3 as seen from the grip end. The shaft 2 is the hollow member of a cylindrical shape and is opened at one end thereof. The grip 3 includes: a grip body 5; and a vibration absorption member 6 separate from the grip body 5.

The grip body 5 includes: a grip cylinder portion 7 shaped like a cylinder and receiving one end of the cylindrical shaft 2 therein; and a grip end portion 9 disposed at one end of the grip cylinder portion 7 and formed with a through-hole 8 for communicating a grip interior with the outside.

The shaft 2 is a carbon shaft formed from a carbon material (CFRP: carbon fiber reinforced plastic), whereas the grip body 5 is formed from rubber. However, the present invention does not particularly limit the materials of the shaft 2 and grip body 5.

The grip body 5 may be formed in a cylindrical shape. Otherwise, a belt-like material may be helically and closely wound on the shaft 2 so as to form a cylindrical shape as a whole (a similar construction to that of a conventional leather wound grip).

The grip end portion 9 is a disk-like portion radially extended to close one end of the cylindrical grip cylinder portion 7. It is noted that the grip end portion 9 is not located at one end face (rear end) of the grip 3 but at place slightly shifted toward the head 4 from the one end face (rear end) of the grip 3. As a result, the grip body 5 possesses an annular step portion 10 extending along the overall circumference of an outside edge of the one end of the grip body and having a height d (axial height). The through-hole 8 is formed centrally of the grip end portion 9, as axially extending through the grip end portion 9.

If the grip end portion 9 has a thickness of less than 2 mm, the grip end portion has an insufficient strength so as to be incapable of withstanding external impact and the like. Therefore, the grip end portion may preferably have a thickness of 2 mm or more, and particularly preferably 3 mm or more. If the thickness of the grip end portion 9 exceeds 8 mm, the grip end portion may have such a great weight as to decrease the manipulability of the golf club 1. Therefore, the grip end portion may preferably have a thickness of 8 mm or less, and particularly preferably 7 mm or less.

The grip cylinder portion 7 and the grip end portion 9 are formed from rubber by a vulcanization forming process. Specifically, an un-vulcanized (or semi-vulcanized) grip end portion 9 formed in a disk shape is set in a grip mold so as to be vulcanized and formed along with an un-vulcanized rubber sheet (portion for forming the grip cylinder portion 7) covering a mandrel (core bar). Thus is obtained the grip 3 including the grip cylinder portion 7 and the grip end portion 9 formed in one piece. From viewpoints of productivity and durability, it is preferred to form the grip end portion 9 and the grip cylinder portion 7 in one piece. Alternatively, an injection moldable material (thermoplastic elastomer or the like) may be used to injection mold the whole body of the grip body 5 including the grip cylinder portion 7 and the grip end portion 9.

The grip cylinder portion 7 is substantially shaped like a cylinder although a back line (not shown) is formed on an inside surface thereof at a predetermined circumferential position. The grip cylinder portion receives the shaft 2 therein. The inside surface of the grip cylinder portion 7 and an outside surface of the shaft 2 are bonded to each other by means of two-sided tape (not shown). An inside diameter of the grip cylinder portion 7 before receiving the shaft 2 therein is slightly smaller than an outside diameter of the shaft 2 as determined at each axial position of the grip cylinder portion 7. Thus, the grip cylinder portion 7 is fitted on the outside surface of the shaft 2 as slightly expanded in diametrical direction.

The vibration absorption member 6 includes: a plane portion 11 as a base portion; and a bar-like portion 12 as a projection. The plane portion 11 is shaped like a disk as extending radially. The bar-like portion 12 is shaped like a bar having a circular section (namely, circular rod) and extends axially from the center of the plane portion 11. The bar-like portion 12 axially extends through the through-hole 8 of the grip end portion 9 and a part thereof defines an inward projection 12*a* projecting inwardly of the shaft 2. In a standstill state of the golf club 1, the inward projection 12*a* does not contact an inside surface 2*a* of the shaft 2 so that a radial gap T is defined between the inward projection 12*a* and the shaft inside surface 2*a*. The inward projection 12*a* and the shaft are arranged in a substantially coaxial relation, so that a gap of substantially equal width T is defined with respect to the overall circumference of the inward projection 12*a*. Hence, the inward projection 12*a* is prone to vibrate in every circumferential direction without contacting the inside surface 2*a* of the shaft 2. An inner side 11*a* (side formed with the bar-like portion 12) of the plane portion 11 is in abutment against an outer side 9*a* of the grip end portion 9.

The vibration absorption member 6 is formed from a viscoelastic material and has the plane portion 11 and the bar-like portion 12 formed in one piece. The vibration absorption member 6 is removably attached to the grip body 5. Specifically, the vibration absorption member 6 is fit-engaged with the grip body 5. The fit-engagement is accomplished by utilizing a dimensional difference between the vibration absorption member 6 and the grip body 5. Specifically, either of the following two methods (1) and (2) (or both) is adopted.

Fit-Engagement method 1: The bar-like portion 12 is so formed as to have a diameter p (diameter of the bar-like portion 12 as a single body) greater than a diameter s of the through-hole 8 (diameter of the through-hole 8 in which the bar-like portion 12 is not inserted).

Fit-Engagement method 2: The plane portion 11 is so formed as to have a diameter 11*d* (diameter of the plane portion not fitted in the step portion 10) greater than a diameter 10*d* of an inside surface of the step portion 10 (diameter of the step portion in which the plane portion 11 is not fitted).

Since FIG. 2(*a*) shows a state where the vibration absorption member 6 is fit-engaged with the grip body 5, the diameter 10*d* of the inside surface of the step portion 10 is shown to be equal to the diameter lid of the plane portion 11. However, the actual diameters 10*d* and 11*d* mean those determined in the state where the vibration absorption member 6 is not attached to the grip body 5 as indicated by the notes in parentheses.

The grip body 5 is formed from a flexible material such as rubber or elastomer, whereas the vibration absorption member 6 also has flexibility as formed from the viscoelastic material. Hence, a constitution for removably securing the vibration absorption member 6 to the grip body 5 may be readily realized by utilizing the dimensional difference as described above. Since the vibration absorption member 6 is removably attachable to the grip body 5, the vibration absorption performance or the weight of the grip may be adjusted by exchanging the vibration absorption members 6. Furthermore, the vibration absorption member 6 and the grip body 5 are separate from each other. Hence, the vibration absorption member 6 and the grip body 5 may be pigmented in different colors thereby enhancing a design characteristic of the golf club.

The method of removably attaching the vibration absorption member 6 to the grip body 5 is not limited to the aforementioned methods. However, it is preferred that the grip body 5 and the vibration absorption member 6 have the fit-engaging function portions for fit-engagement with each other, as suggested by the above methods (1) and (2), because a simple structure permits the vibration absorption member 6 to be removably attached to the grip body. As required, other constitutions for removably attaching the vibration absorption member 6 may be adopted. For instance, a separate member from the grip body 5 and the vibration absorption member 6 may be used to press down on an outer side of the vibration absorption member 6 so as to secure the vibration absorption member to the grip body. Hook and loop fasteners may be used, or magnets may be used. An alternative constitution may be made such that the vibration absorption member 6 is screwed into the grip body 5.

The plane portion 11 of the vibration absorption member 6 has a thickness h (thickness with respect to the axial direction) equal to the height d (height with respect to the axial direction) of the step portion 10. Therefore, an axial end face 10*a* of the step portion 10 is flush with an outer side 11*b* of the plane portion 11.

Examples of a suitable viscoelastic material for forming the vibration absorption member 6 include thermoplastic elastomers such as SBR, PEBAX (commercially available from ATOCHEM Inc.), HYBRAR (tradename; commercially available from Kuraray Co., Ltd.); HYBRAR+PP (the above HYBRAR blended with polyproplylene); and the like. A suitable SBR may be prepared by, for example, admixing 1.5 parts by weight of sulfur to 100 parts by weight of base rubber of SBR (complex elastic modulus: $5.07\times10^7$ dyn/cm$^2$). Other suitable viscoelastic materials include SBR admixed with carbon black (complex elastic modulus: $3.86\times10^8$ dyn/cm$^2$), PEBAX (PEBAX5533 commercially available from ATOCHEM Inc.) (complex elastic modulus: $2.72\times10^9$ dyn/cm$^2$), 11-NYLON (complex elastic modulus: $1.45\times10^{10}$ dyn/cm$^2$), silicone rubber (complex elastic modulus: $1.41\times10^7$ dyn/cm$^2$) and the like. Of these materials, PEBAX and 11-NYLON may be formed by injection molding, whereas the other materials may be formed by press molding.

The viscoelastic material for forming the bar-like portion 12 (projection) is defined to have a complex elastic modulus of $2.0\times10^7$ dyn/cm$^2$ or more and $1.0\times10^{10}$ dyn/cm$^2$ or less as determined at temperature of 0 to 10° C. and at a frequency of 10 Hz. If the bar-like portion 12 (projection) has a complex elastic modulus of less than $2.0\times10^7$ dyn/cm$^2$, the bar-like portion 12 is too soft, involving fear that the golf club 1 may become instable during swing motion or that the bar-like portion 12 may vibrate excessively to cause echo sound. Furthermore, the vibration amplitude of the bar-like portion 12 may not agree with the vibration frequency of the shaft 2. Therefore, the above complex elastic modulus may be more preferably $2.5\times10^7$ dyn/cm$^2$ or more, even more preferably $3.0\times10^7$ dyn/cm$^2$ or more, and particularly preferably $5.0\times10^7$ dyn/cm$^2$ or more.

If the bar-like portion 12 has a complex elastic modulus of more than $1.0\times10^{10}$ dyn/cm$^2$, the bar-like portion 12 is too hard, involving fear that the vibration amplitude thereof may be decreased and may not agree with the vibration frequency of the shaft. Therefore, the above complex elastic modulus may be more preferably $8.0\times10^9$ dyn/cm$^2$ or less, even more preferably $6.0\times10^9$ dyn/cm$^2$ or less, and particularly preferably $3.0\times10^9$ dyn/cm$^2$ or less.

The mass of the bar-like portion 12 (projection) is defined to be 0.7 g or more and 6 g or less. If the bar-like portion 12 has a mass of more than 6 g, the whole body of the golf club 1 has such a great weight as to be degraded in the manipulability. Therefore, the mass of the bar-like portion 12 (projection) may be more preferably 5.5 g or less, and particularly preferably 5 g or less. If the bar-like portion 12 has a mass of less than 0.7 g, the bar-like portion 12 may not be fully brought into resonant vibrations, failing to exhibit an adequate vibration absorption performance. Therefore, the mass of the bar-like portion 12 may be more preferably 1.0 g or more, even more preferably 1.5 g or more, and particularly preferably 2 g or more.

The length (longitudinal length) of the bar-like portion 12 (projection) is defined to be 8 mm or more and 40 mm or less. If the bar-like portion 12 has a length of less than 8 mm, the bar-like portion 12 may not be fully brought into the resonant vibrations, failing to exhibit the adequate vibration absorption performance. Therefore, the length of the bar-like portion may be more preferably 10 mm or more, even more preferably 15 mm or mare, and particularly preferably 20 mm or more. On the other hand, if the bar-like portion 12 has a length of more than 40 mm, the vibration amplitude of the bar-like portion 12 is increased so much that the amplitude may not agree with the frequency of the shaft. Furthermore, the projection and the inside surface of the shaft are more likely to contact each other, so that the possibility of echo sound increases. Therefore, the length may be more preferably 38 mm or less, even more preferably 36 mm or less, and particularly preferably 34 mm or less.

The vibration absorption member 6 is formed from a viscoelastic material admixed with a powdery metal of high specific gravity of 7 or more. This is because the vibration absorption member 6 may be downsized so that the vibration absorption member 6 may not project excessively outwardly of the grip body and that the degree of freedom of designing the grip body 5 and the shaft 2 may be increased. What is more, it is easy for the bar-like portion 12 (projection) to provide the adequate vibration absorption performance, even if the sectional area thereof is decreased. This makes it easy for the projection to provide a consistent vibration absorption performance as prevented from contacting the inside surface of the shaft. This also leads to an increased degree of freedom of designing the grip body 5 (particularly, the grip cylinder portion 7) and the thickness of the shaft 2. Accordingly, the specific gravity of the high-specific-gravity metal may be more preferably 10 or more, and particularly preferably 15 or more. In the light of the availability or cost of the high-specific-gravity metal, the specific gravity thereof may be more preferably 22 or less, and even more preferably 20 or less.

Specific examples of the metal having the high specific gravity of 7 or more include: iron (specific gravity: 7.86), copper (specific gravity: 8.92), lead (specific gravity: 11.3), nickel (specific gravity: 8.85), zinc (specific gravity: 7.14), gold (specific gravity: 19.3), platinum (specific gravity: 21.4), osmium (specific gravity: 22.6), iridium (specific gravity: 22.4), tantalum (specific gravity: 16.7), silver (specific gravity: 10.49), chromium (specific gravity: 7.19), brass (specific gravity: 8.5), tungsten (specific gravity: 19.3) and the like; and alloys containing at least one of these. It is noted that lead is hazardous to organisms, whereas gold and silver are expensive. Hence, it is preferred to use tungsten, copper, nickel or an alloy thereof. Furthermore, the high-specific-gravity metal may be preferably treated with a coupling agent (for example, coated with a silane coupling agent) for enhancing adhesion to a macromolecule material (viscoelastic material).

The diameter p of the bar-like portion 12 may be preferably 2 mm or more and 4 mm or less. If the bar-like portion 12 has a diameter of less than 2 mm, the vibration amplitude of the bar-like member 12 is so great as not to agree with the frequency of the shaft. If the diameter exceeds 4 mm, the bar-like portion 12 may not be fully brought into the resonant vibrations. In either case, the bar-like portion may be decreased in the vibration absorption performance.

FIG. 3 to FIG. 6 are sectional views showing other embodiments (second to fifth embodiments) of the present invention. Each of the embodiments resembles the first embodiment of FIG. 2 in that the inner side 11*a* of the plane portion 11 is in abutment against the outer side 9*a* of the grip end portion 9 and that the vibration absorption member 6 is removably attached to the grip body 5 by the above-mentioned fit-engagement method (1) or the fit-engagement method (2). In the following description on the second to fifth embodiments, the description on those parts resemblant to those of the first embodiment is omitted. The description focuses on difference from the first embodiment.

Figure 3:
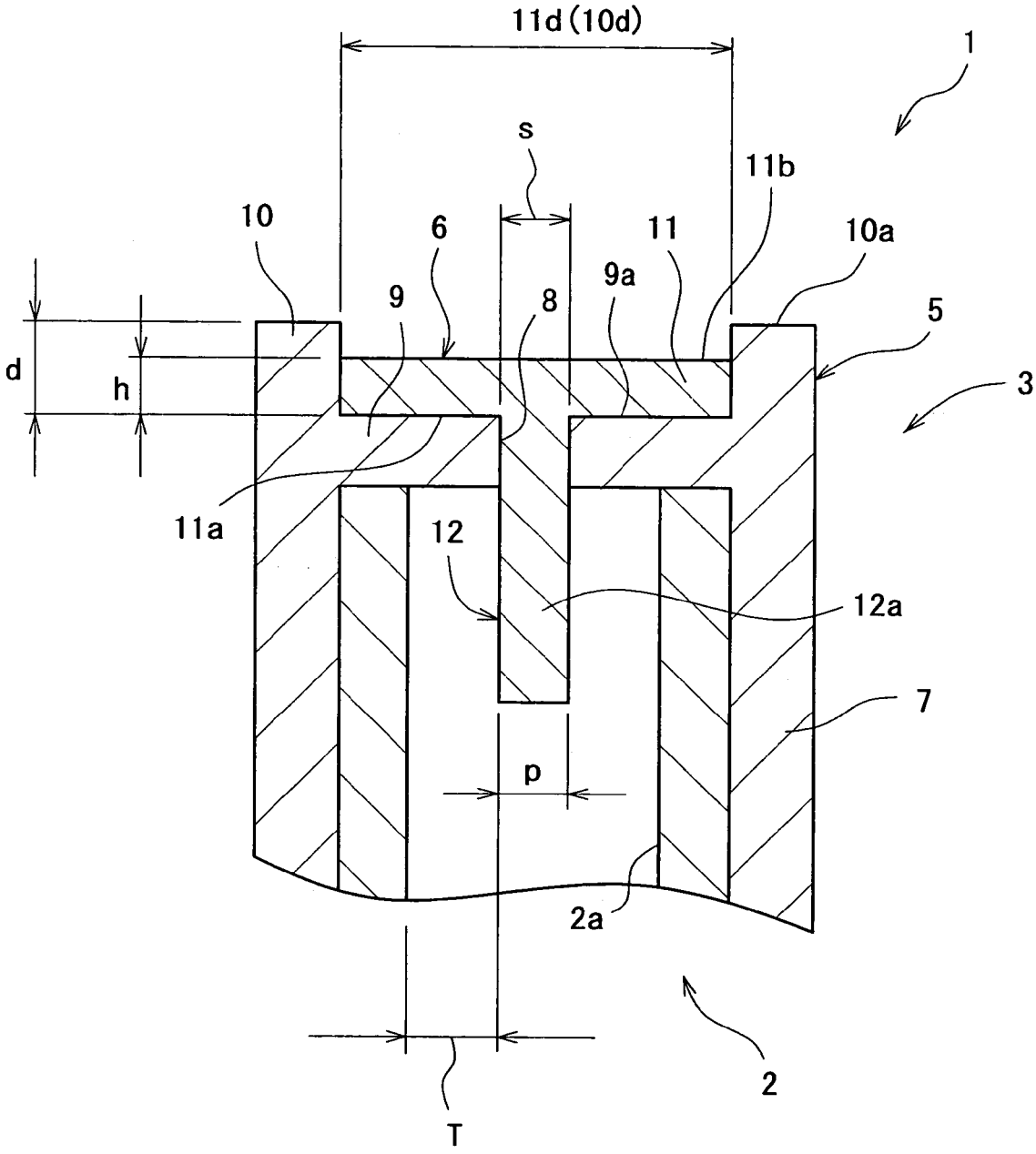
FIG. 3 is a sectional view of a golf club grip according to a second embodiment of the present invention.

According to the second embodiment shown in FIG. 3, the height d of the step portion 10 is defined to be greater than the thickness h of the plane portion 11 of the vibration absorption member 6. Accordingly, the axial end face 10*a* of the step portion 10 is not flush with the outer side 11*b* of the plane portion 11. Thus, the step portion 10 axially projects by a thickness difference (d−h).

Figure 4:
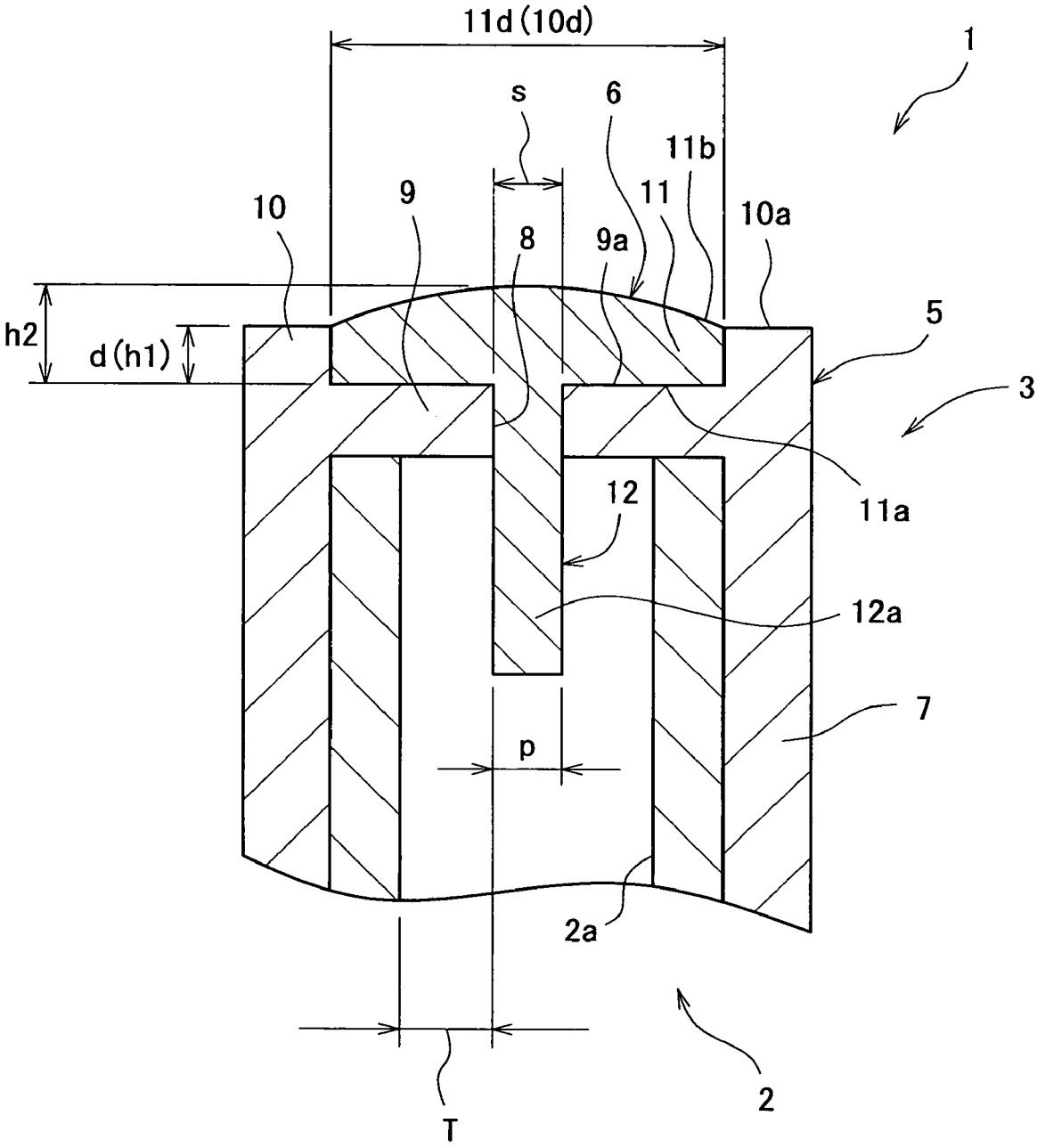
FIG. 4 is a sectional view of a golf club grip according to a third embodiment of the present invention.

Unlike the first and second embodiments, the plane portion 11 of the third embodiment shown in FIG. 4 does not have a constant thickness but has its thickness progressively increased from an outside circumference thereof toward the center thereof. Thus, the outer side 11*b* of the plane portion 11 defines a convexed surface protruded outwardly. Accordingly, a thickness h1 (axial thickness) of the plane portion 11 at the outside circumference thereof is smaller than a thickness h2 thereof at the center thereof. The height d of the step portion 10 is defined to be equal to the thickness h1 of the plane portion 11 at the outside circumference thereof. Thus, the vibration absorption member 6 axially protrudes by a thickness difference (h2−h1) at the center of the outer side 11*b* of the plane portion 11.

Figure 5:
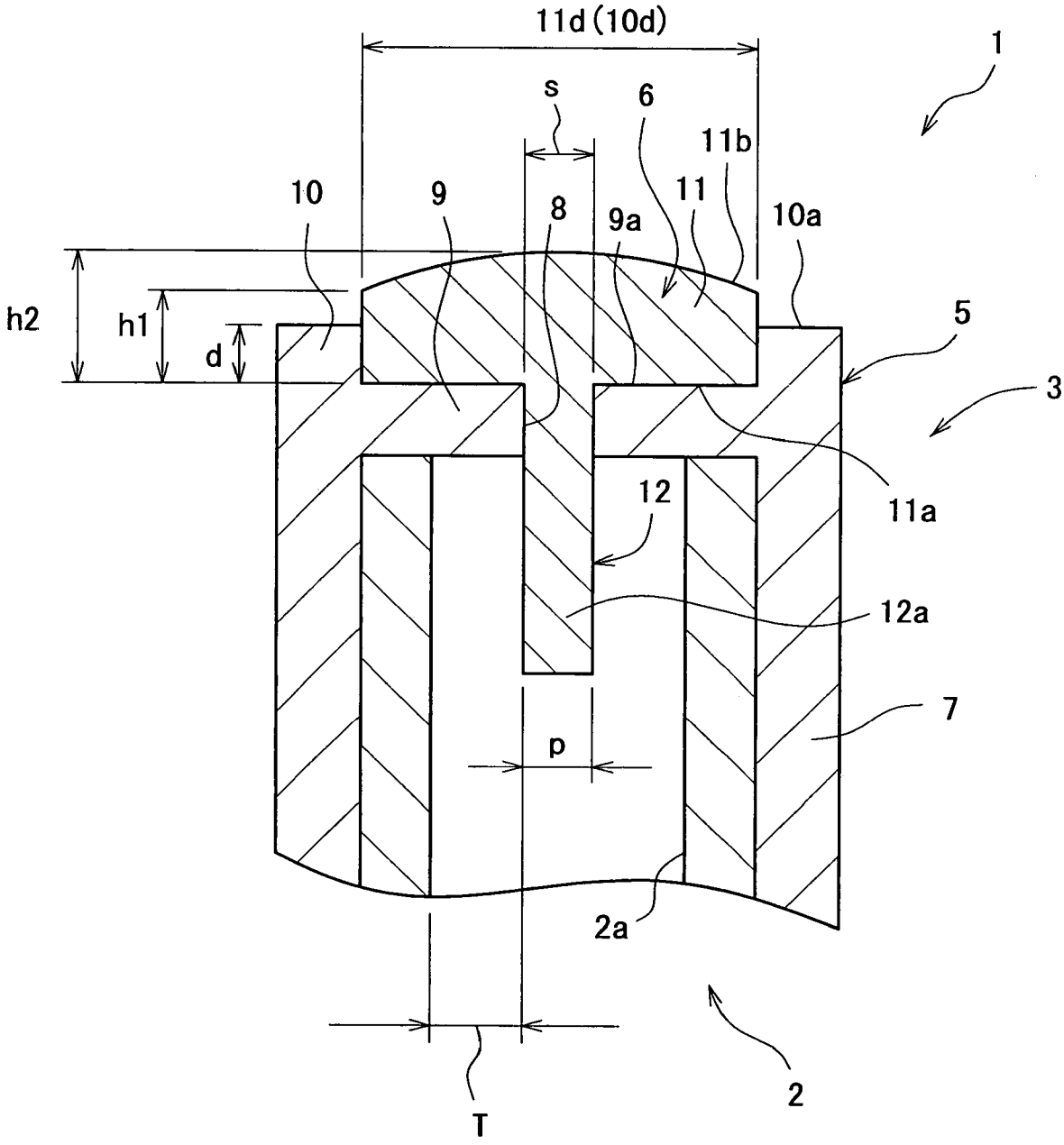
FIG. 5 is a sectional view of a golf club grip according to a fourth embodiment of the present invention.

Similarly to the third embodiment, the plane portion 11 of the vibration absorption member 6 of the fourth embodiment shown in FIG. 5 is varied in the thickness thereof. The thickness of the plane portion 11 is progressively increased from the outside circumference thereof toward the center thereof. Thus, the outer side 11*b* of the plane portion 11 defines a convexed surface protruded outwardly. Accordingly, the thickness h1 (axial thickness) of the plane portion 11 at the outside circumference thereof is smaller than the thickness h2 of the plane portion 11 at the center thereof. Unlike the third embodiment, however, the thickness h1 of the plane portion 11 at the outside circumference thereof is greater than the height d of the step portion 10. Accordingly, a height difference (axial height) (h1−d) is provided between the outside circumference of the plane portion 11 of the vibration absorption member 6 and the step portion 10.

Figure 6:
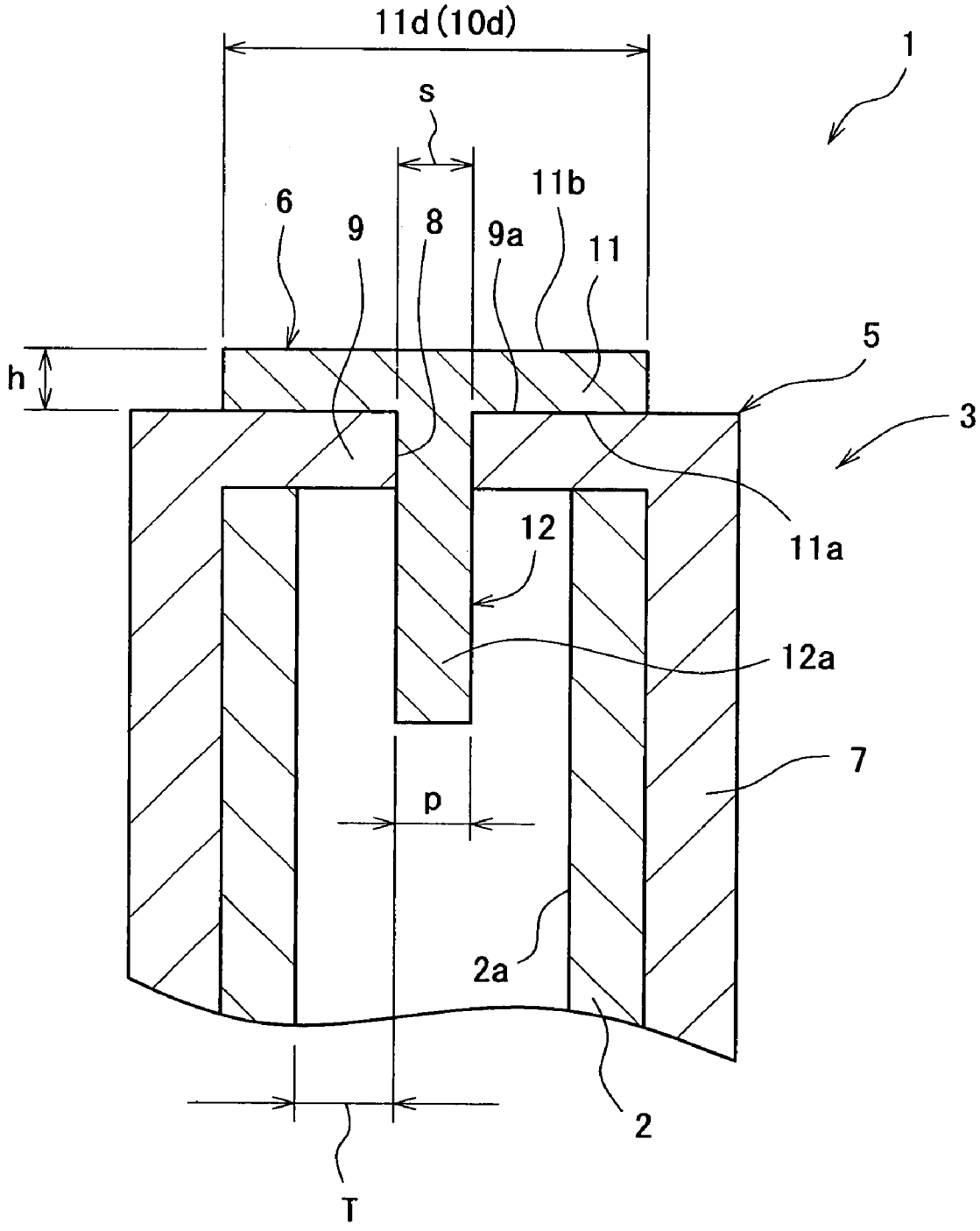
FIG. 6 is a sectional view of a golf club grip according to a fifth embodiment of the present invention.

The grip 3 of the fifth embodiment shown in FIG. 6 differs from those of the aforementioned first to fourth embodiments in that the grip body 5 is not formed with the step portion 10 at the outside circumference of the end thereof. In the first to fourth embodiments, the step portion 10 is formed so that the area inside the step portion 10 defines a recess for receiving the plane portion 11 of the vibration absorption member 6.

However, the fifth embodiment is not provided with the step portion 10. That is, the recess for receiving the plane portion 11 of the vibration absorption member 6 is not formed. Hence, the whole body of the plane portion 11 is exposed outside.

While the embodiment of the present invention is not limited to the aforementioned first to fifth embodiments, the first to fifth embodiments are, preferred because these embodiments may adopt the aforementioned fit-engagement method 1 or the fit-engagement method 2, and because the inner side 11*a* of the plane portion 11 is in abutment against the outer side 9*a* of the grip end portion 9 so that the vibration absorption member 6 is stably mounted. As the vibration absorption member 6 is protruded further outwardly, the vibration absorption member 6 is more prone to be disengaged and is more decreased in durability. In view of this fact, among the first to fifth embodiments, the first to fourth embodiments are more preferred. Even more preferred are the first to third embodiments. Particularly preferred are the first and second embodiments.

The distance T between the bar-like portion 12 (projection) and the shaft inside surface 2*a* may be preferably 4 mm or more. If the distance T is less than 4 mm, it is likely that the bar-like portion 12 in resonant vibrations comes into contact with the inside surface 2*a* of the shaft 2 to cause the echo sound or uncomfortable vibrations. Therefore, the distance T maybe preferably 4 mm or more and particularly preferably 5 mm or more. In addition, the distance t may be preferably 7 mm or less. In a case where this distance exceeds 7 mm, if the shaft 2*a* has, for example, a common inside diameter on the order of 15 mm, the bar-like portion 12 has an outside diameter on the order of 1 mm, so that the bar-like portion may fail to offer the adequate vibration suppression effect.

Although the bar-like portion 12 (projection) in the foregoing embodiments is shaped like a circular rod, the bar-like portion may be shaped like a rectangular rod, a rod having an elliptical section, or a rod having a section of any other different shape. However, the bar-like portion 12 (projection) may preferably have a circular section because such a bar-like portion is capable of vibrating circumferentially uniformly. The bar-like portion 12 (projection) may be formed with a weight portion which is formed by expanding an outside diameter of a distal end thereof from an outside diameter at the other part thereof. In this case, the bar-like portion 12 (projection) is more prone to vibrations due to the weight portion thereof, thus achieving a greater vibration suppression effect.

The outside diameter of the bar-like portion 12 (projection) may be preferably 1.0 mm or more, and even more preferably 1.5 mm or more. The most preferred value is 3.0 mm or more. If this outside diameter is too small, the bar-like portion cannot provide the adequate vibration suppression effect. However, if this outside diameter is too great, the bar-like portion is more likely to contact the shaft inside surface. Therefore, the outside diameter may be preferably 7.0 mm or less, and more preferably 6.0 mm or less. The most preferred value is 5.0 mm or less.

EXAMPLES AND COMPARATIVE EXAMPLE

The effects of the present invention were verified by way of the evaluation of Examples 1 to 7 and Comparative example 1 which have the following specifications. The specifications of the respective examples are as follows.

All the examples 1 to 7 and comparative example 1 shared common head, shaft and grip body. Specifically, each golf club was fabricated by assembling a 46-inch shaft and a grip body to a wood-type golf club head (so-called driver head). The shaft was tapered with its diameter progressively decreased from BUTT side (grip mounting side) toward TIP side (headmounting side). The shaft had a weight (pre-painting weight) of 60 g.

The shaft was a carbon shaft which was formed by a sheet winding method wherein CRFP prepreg sheets were wound in lamination. Specifically, a plurality of fiber-reinforced prepreg sheets in predetermined shapes were sequentially wound about a core bar (not shown) to form a lamination. Subsequently, the lamination was wrapped with a tape such as formed of a polyethylene terephthalate resin. The lamination with the tape was heated under pressure in an oven so as to cure the resin for integral forming. Subsequently, a hollow cylindrical shaft was obtained by drawing out the core bar from the lamination. The prepreg sheets illustrating the lamination construction of the shaft are schematically shown in a developed view of FIG. 7. The left sides of fiber-reinforced prepreg sheets 51 to 57, as seen in the figure, represent the grip side (BUTT side), whereas the right sides thereof represent the head side (TIP side). The fiber-reinforced prepreg sheets 51 to 57 are sequentially wound about the core bar (mandrel; not shown) from the inside circumferential side (in the order of the fiber-reinforced prepreg sheet 51→52→ . . . 57) so as to be laminated with one another. The fiber-reinforced prepreg sheets 51 to 57 all use carbon fibers, as reinforcing fibers F51 to F57, having tension moduli in the range of 30 tonf/mm$^2$ or more and 80 tonf/mm$^2$ or less, and an epoxy resin as matrix resin.

Figure 7:
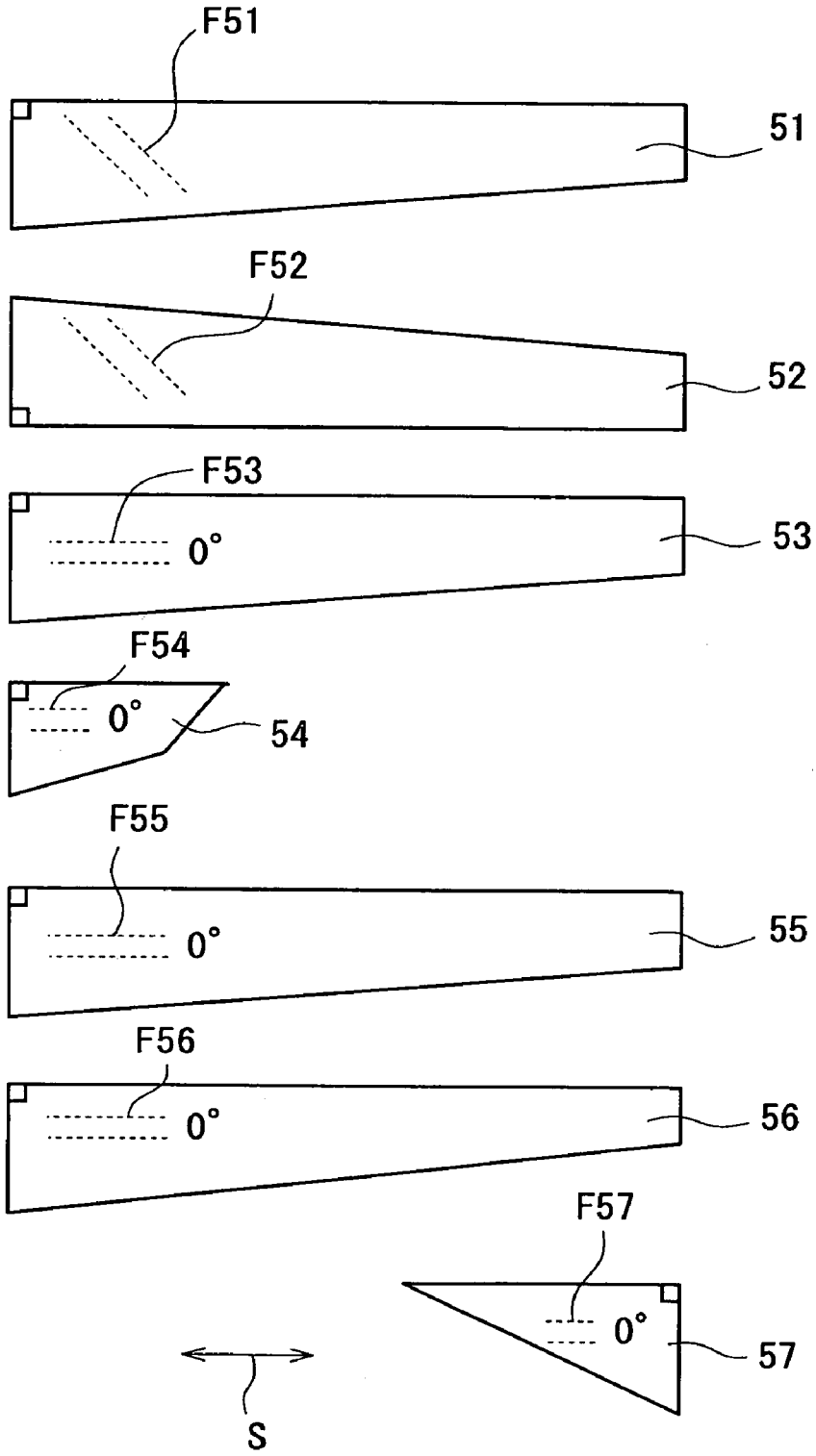
FIG. 7 is a developed view of prepreg sheets of a shaft of examples and a comparative example of the present invention.

The fiber-reinforced prepreg sheets 51, 52 are laminated with each other as bonded in a manner that the reinforcing fibers F51, F52 (tension modulus: 40 tonf/mm$^2$) have respective orientation angles of −45° and +45° with respect to a direction S of the shaft axis. As seen in FIG. 7, F51 and F52 are orientated in the same direction. By bonding the reversed prepreg sheet 52 to the prepreg sheet 51, however, the reinforcing fibers F51 and F52 are oriented in the opposite directions. The fiber-reinforced prepreg sheet 53 has the reinforcing fiber F53 (tension modulus: 30 tonf/mm$^2$) oriented at an angle of 0° with respect to the direction S of the shaft axis. The fiber-reinforced prepreg sheet 54 has the reinforcing fiber F54 (tension modulus: 80 tonf/mm$^2$) oriented at an angle of 0° with respect to the direction S of the shaft axis and is located on the grip side (BUTT side) for reinforcing a grip-side end (BUTT side). The fiber-reinforced prepreg sheets 55, 56 have the reinforcing fibers F55, F56 (tension modulus: 30 tonf/mm$^2$) oriented at an angle of 0° with respect to the direction S of the shaft axis. The fiber-reinforced prepreg sheet 57 has the reinforcing fiber F57 (tension modulus: 30 tonf/mm$^2$) oriented at an angle of 0° with respect to the direction S of the shaft axis and is located on the head side (TIP side) for reinforcing a head-side distal end.

It is preferred from the standpoint of weight reduction of the shaft that the prepreg sheets reinforced with the carbon fibers having the tension moduli in the range of 30 tonf/mm$^2$ or more and 80 tonf/mm$^2$ or less, as described above, account for 50 wt % or more of the overall (pre-painting) weight of the shaft.

The grip body of the grip was prepared by integrally forming the grip cylinder portion and the grip end portion. A rubber compound containing 1.5 parts by weight of sulfur and 40 parts by weight of carbon black based on 100 parts by weight of SBR was press-molded at 150° C. for 30 minutes thereby to form the grip body. The whole body of the vibration absorption member including the plane portion and the bar-like portion was formed in one piece.

Example 1

In Example 1, the grip having the same constitution as that of the second embodiment shown in FIG. 3 was assembled with the aforesaid head and shaft. A viscoelastic material for forming the vibration absorption member contained 1.5 parts by weight of sulfur based on 100 parts by weight of SBR as the base rubber. The viscoelastic material had a complex elastic modulus of $5.07\times10^7$ dyn/cm$^2$. The bar-like portion (projection) was shaped like a circular rod having a length of 50 mm and a diameter (outside diameter) of 1 mm.

Example 2

A golf club of Example 2 was fabricated the same way as in Example 1, except that the bar-like portion (projection) had an outside diameter of 3 mm and a length of 30 mm.

Example 3

A golf club of Example 3 was fabricated the same way as in Example 2, except that a viscoelastic material for forming the vibration absorption member contained 1.5 parts by weight of sulfur and 90 parts by weight of tungsten powder (SG50 commercially available from Tokyo Tungsten Co., Ltd) based on 100 parts by weight of SBR as the base rubber. The viscoelastic material had a complex elastic modulus of $8.80\times10^7$ dyn/cm$^2$.

Example 4

A golf club of Example 4 was fabricated the same way as in Example 2, except that a viscoelastic material for forming the vibration absorption member contained 1.5 parts by weight of sulfur and 350 parts by weight of tungsten powder (SG50 commercially available from Tokyo Tungsten Co., Ltd) based on 100 parts by weight of SBR as the base rubber. The viscoelastic material had a complex elastic modulus of $1.72\times10^8$ dyn/cm$^2$.

Example 5

A golf club of Example 5 was fabricated the same way as in Example 2, except that a viscoelastic material for forming the vibration absorption member contained 1.5 parts by weight of sulfur and 700 parts by weight of tungsten powder (SG50 commercially available from Tokyo Tungsten Co., Ltd) based on 100 parts by weight of SBR as the base rubber. The viscoelastic material had a complex elastic modulus of $4.72\times10^8$ dyn/cm$^2$.

Example 6

A golf club of Example 6 was fabricated the same way as in Example 2, except that a viscoelastic material for forming the vibration absorption member contained 1.5 parts by weight of sulfur and 1200 parts by weight of tungsten powder (SG50 commercially available from Tokyo Tungsten Co., Ltd) based on 100 parts by weight of SBR as the base rubber. The viscoelastic material had a complex elastic modulus of $7.90\times10^9$ dyn/cm$^2$.

Example 7

A golf club of Example 7 was fabricated the same way as in Example 1, except that the bar-like portion (projection) had an outside diameter of 5 mm and a length of 7 mm and that a viscoelastic material for forming the vibration absorption member contained 1.5 parts by weight of sulfur and 1800 parts by weight of tungsten powder (SG50 commercially available from Tokyo Tungsten Co., Ltd) based on 100 parts by weight of SBR as the base rubber. The viscoelastic material had a complex elastic modulus of $1.24\times10^{10}$ dyn/cm$^2$.

Comparative Example 1

A golf club of Comparative Example 1 was fabricated the same way as in Example 1, except that the vibration absorption member was omitted.

The following table 1 lists the specifications of the examples and evaluation results thereof.

TABLE 1

| | | (unit) | Ex. 1 | Ex. 2 | Ex. 3 | Ex. 4 | Ex. 5 | Ex. 6 | Ex. 7 | C. Ex. 1 |
|---|---|---|---|---|---|---|---|---|---|---|
| viscoelastic material specification | material | — | SBR | SBR | SBR + W | SBR + W | SBR + W | SBR + W | SBR + W | — |
| | tungsten mixing ratio | parts by weight | — | — | 90 | 350 | 700 | 1200 | 1800 | — |
| | complex elastic modulus | dyn/cm$^2$ | 5.07E+07 | 5.07E+07 | 8.80E+07 | 1.72E+08 | 4.72E+08 | 7.90E+09 | 1.24E+10 | — |
| bar (projection) specification | outside diameter | mm | 1 | 3 | 3 | 3 | 3 | 3 | 5 | — |
| | length | mm | 50 | 30 | 30 | 30 | 30 | 30 | 7 | — |
| | volume | mm$^3$ | 0.55 | 0.72 | 0.72 | 0.72 | 0.72 | 0.72 | 0.71 | — |
| | specific gravity | | 1.2 | 1.2 | 2 | 4 | 6 | 8 | 10 | — |
| | weight | g | 0.66 | 0.86 | 1.44 | 2.88 | 4.32 | 5.76 | 7.10 | — |
| gap between bar and shaft inside surface | | mm | 7 | 6 | 6 | 6 | 6 | 6 | 5 | — |
| thickness of grip end | | mm | 2 | 2 | 2 | 2 | 2 | 2 | 2 | — |
| total club weight | | g | 310 | 312 | 312 | 313 | 315 | 317 | 320 | 308 |
| club balance (centroid position) | | mm | 853 | 853 | 852 | 852 | 852 | 851 | 851 | 854 |
| inertial moment in swing direction | | $\times10^3$ g · cm$^2$ | 2925 | 2930 | 2939 | 2942 | 2948 | 2960 | 3001 | 2910 |
| vibration damping factor | | % | 0.61 | 0.86 | 1.01 | 1.21 | 1.09 | 0.88 | 0.60 | 0.35 |

TABLE 1-continued

| | | (unit) | Ex. 1 | Ex. 2 | Ex. 3 | Ex. 4 | Ex. 5 | Ex. 6 | Ex. 7 | C. Ex. 1 |
|---|---|---|---|---|---|---|---|---|---|---|
| practical hit performance | ease of swing | — | 4.1 | 4.1 | 4.1 | 4.0 | 4.0 | 3.8 | 3.6 | 4.2 |
| | vibration absorption performance | — | 3.3 | 3.9 | 4.0 | 4.2 | 4.0 | 3.9 | 3.4 | 2.9 |

In the table, the term "gap between bar-like portion and shaft inside surface" means the aforementioned radial distance T (FIG. 3). The term "thickness of grip end portion" means the axial thickness of the grip end portion. The term. "club balance" means the axial distance from the BUTT side end of the club (grip end) to the center of gravity of the club.

The term "inertial moment in swing direction" means the inertial moment of the club rotated in the swing direction about a rotary axis through the grip end. The rotary axis based on which the inertial moment in the swing direction is measured is defined by an axis extending through the grip end and perpendicular to the shaft axis. The inertial moment in the swing direction is determined in a state where a movement direction (circumferential direction) of the head moved in conjunction with the rotation of the club about the rotary axis is aligned with a direction of the face surface (normal direction of the face surface as determined at face center). The inertial moment in the swing direction, as listed in the table, is measured in [$\times 10^3$ g·cm$^2$].

[Evaluation]

Figure 8:
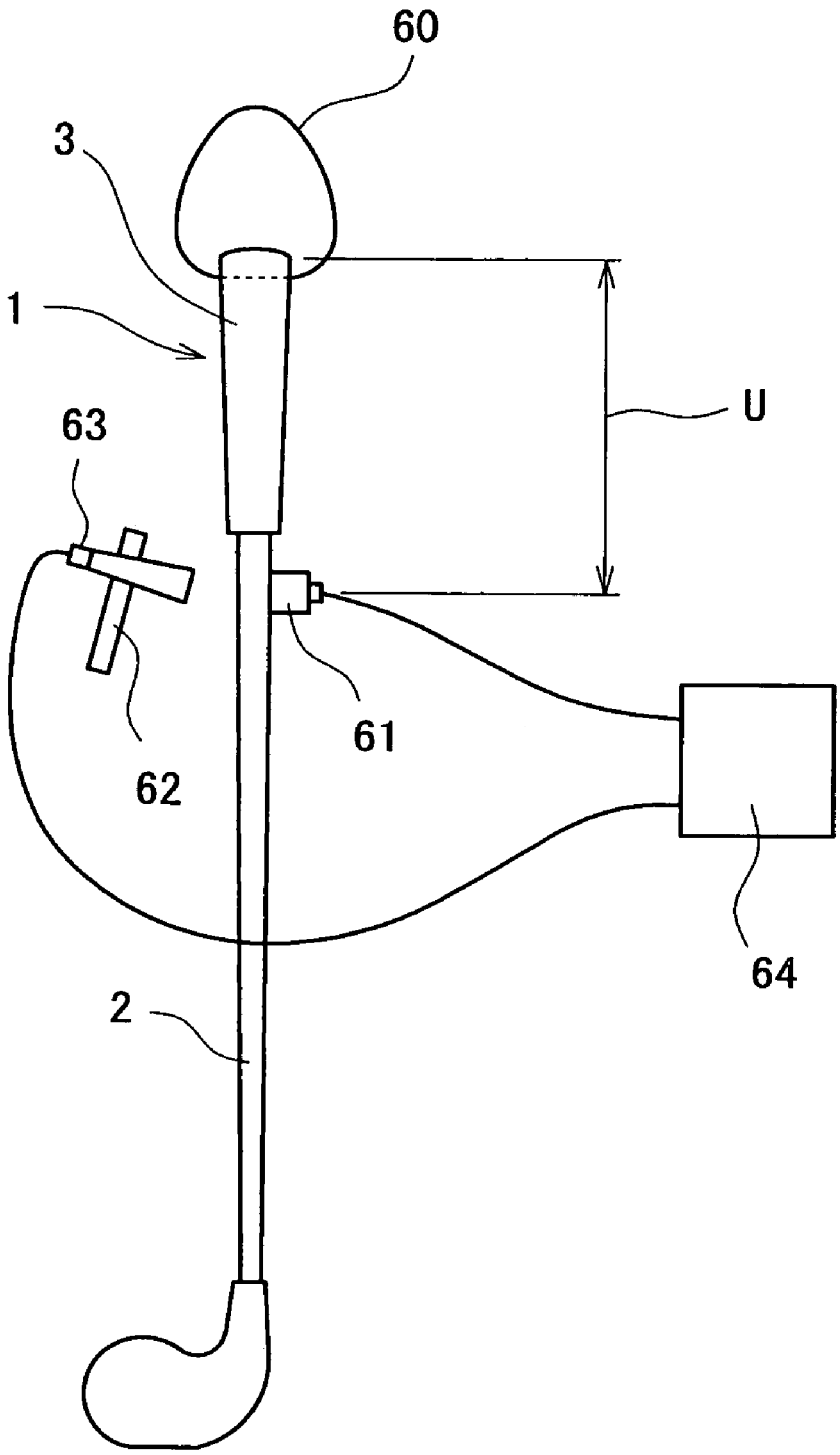
FIG. 8 is a diagram for explaining a measurement method for vibration damping factor.

The golf clubs of the examples and comparative example were evaluated for measurement values of the vibration damping factor of the shaft and for practical hit performance. The vibration damping factor was measured as follows. As shown in FIG. 8, the shaft 2 of the golf club 1 was suspended by way of a cord 60 threaded through the grip end. An acceleration pick-up meter 61 was attached to the shaft at place spaced away from the grip end by a distance U of 370 mm. An impact hammer 62 equipped with a force pick-up meter 63 was used to apply impact to place opposite from the acceleration pick-up meter 61 so attached, thereby to bring the shaft into vibrations. An input vibration given by the force pick-up meter 63 and a response vibration given by the acceleration pick-up meter 61 were analyzed by an FET analyzer 64, whereby the vibration damping factor was calculated. The greater the value of the vibration damping factor, the higher the vibration suppression effect.

The practical hit performance was evaluated in terms of the ease of swing and the vibration absorption performance. The evaluation test was conducted as follows. Twenty-six low- or intermediate handicap golfers (men having golf experience of more than 10 years and playing golf at least once a month) were each asked to hit balls. The golfers evaluated the respective golf clubs in terms of the ease of swing and the vibration absorption performance on a one-to-five scale (the higher score indicating the better evaluation). A mean value of the scores of each of the examples and comparative example was calculated. The examples and comparative example were compared based on the resultant mean values.

[Measurement of Complex Elastic Modulus]

The complex elastic modulus was determined as follows. Each sample piece was prepared based on predetermined conditions and was subjected to a viscoelasticity analyzer (New Model DVA200 of Viscoelastic Spectrometer commercially available from Shimadzu Corporation). The sample piece had a width of 4.0 mm, a thickness of 1.66 mm and a length of 30.0 mm. A displacement portion of the sample piece had a length of 20.0 mm. The displacement portion was brought into vibrations by displacing the same in a pulling direction under conditions including: frequency of 10 Hz, temperature rise rate of 2° C./min., initial strain of 2 mm and displacement amplitude of ±12.5 μm. Measurement values taken at 10° C. were used for the evaluation.

As shown in Table 1, all the examples achieve higher values of the vibration damping factor and of the vibration absorption performance in the practical hit performance, as compared with the comparative example. The golf club of Example 1 has a relatively lower vibration damping factor than those of the other examples because this golf club has a longer and thinner projection than those of the other examples, so that disagreement between the frequency of the bar-like portion 12 and the club frequency is more significant than such disagreements encountered by the other examples. In Examples 3 to 7, for aiming at further improvement of the vibration absorption performance, the tungsten powder is used to increase the specific gravity of the bar-like portion (projection) and to adjust the complex elastic modulus. As a result, the golf clubs of Examples 3 to 6 achieve particularly favorable vibration absorption performances. What is more, these golf clubs, which are increased in total weight, offer as easy shaft swing as the golf club of Example 1. However, the golf club of Example 7 exhibits a relatively lower vibration absorption performance because the bar-like portion 12 is excessively increased in the specific gravity so that the disagreement between the frequency thereof and the club frequency is increased. In addition, the golf club of Example 7 is inferior to the other golf clubs in the ease of swing, because of the increased total club weight and inertial moment in the swing direction. As to the ease of swing, the golf club of Example 7 was comparatively favorably evaluated by the low handicap golfers of the testers, who swing the clubs at high head speeds. However, this golf club was poorly evaluated by senior golfers who felt the club too heavy. The senior golfers swing the clubs at low head speeds and hence, require a good carry performance from the club. As overall mean, Example 7 has a relatively lower score, as shown in the table.

It is thus confirmed from the above results that the present invention provides the favorable golf clubs capable of effectively suppressing the shaft vibrations without relying on substantial weight increase, thereby offering good hit feeling.

What is claimed:

1. A golf club grip comprising:

a grip body including a grip cylinder portion shaped like a cylinder and receiving one end of a cylindrical shaft therein;

a grip end portion disposed at one end of the grip cylinder portion and formed with a through-hole for communicating a grip interior with the outside;

a vibration absorption member formed from a viscoelastic material admixed with a powdery metal of high specific gravity of 10 or more, formed separately from the grip body, and removably attached to the grip body, wherein the vibration absorption member includes a base portion and a projection formed integrally with the base portion, and the projection extends through the through-hole of the grip end portion and projects inwardly of the grip cylinder portion; and wherein the grip body has (1) an annular step portion extending along the overall circumference of an outside edge of the one end of the grip body and having a height and (2) a recess inside the annular step portion for housing therein the base portion of the vibration absorption member, the vibration absorption member being attached to the grip body in such a way that an inner side of the base portion of the vibration absorption member is in abutment against a bottom surface of the recess.

2. A golf club grip according to claim 1, wherein the vibration absorption member is removably attached to the grip body by way of fit-engagement with the grip body.

3. A golf club grip according to claim 2, wherein the projection is shaped like a bar, having a complex elastic modulus of $2.0\times10^{7}$ dyn/cm$^2$ or more and $1.0\times10^{10}$ dyn/cm$^2$ or less as determined at temperature of 0 to 10° C. and at a frequency of 10 Hz, a mass of 0.7 g or more and 6 g or less, and a length of 8 mm or more and 40 mm or less.

4. A golf club grip according to claim 1, wherein the projection is shaped like a bar, having a complex elastic modulus of $2.0\times10^{7}$ $^{dyn/cm2}$ or more and $1.0\times10^{10}$ dyn/cm$^2$ or less as determined at temperature of 0 to 10° C. and at a frequency of 10 Hz, a mass of 0.7 g or more and 6 g or less, and a length of 8 mm or more and 40 mm or less.

5. A golf club grip according to claim 3, wherein the vibration absorption member is formed from a visceLastic material admixed with a powdery metal of high specific gravity of 7 or more.

6. A golf club grip according to claim 1, wherein the vibration absorption member is formed from a viscoelastic material admixed with a powdery metal of high specific gravity of 7 or more.

7. A golf club grip according to claim 1, wherein the inner side of the base portion of the vibration absorption member is perfectly in abutment against the bottom surface of the recess.

8. A golf club grip according to claim 1, wherein the vibration absorption member is removably attached to the grip body by way of fit-engagement with the grip body.

9. A golf club grip according to claim 1, wherein the projection is shaped like a bar, having a complex elastic modulus of $2.0\times10^{7}$ dynlcm$^2$ or more and $1.0\times10^{10}$ dyn/cm$^2$ or less as determined at temperature of 0 to 10° C. and at a frequency of 10 Hz, a mass of 0.7 g or more and 6 g or less, and a length of 8 mm or more and 40 mm or less.

10. A golf club comprising:

a grip body including a cylindrical grip cylinder portion;

a grip end portion disposed at one end of the grip cylinder portion and formed with a through-hole for communicating a grip interior with the outside;

a vibration absorption member formed from a viscoelastic material admixed with a powdery metal of high specific gravity of 10 or more, formed separately from the grip body and removably attached to the grip body;

a cylindrical shaft having one end inserted in the grip cylinder portion; and a golf club head attached to the other end of the shaft, wherein the vibration absorption member includes a base portion and a projection formed integrally with the base portion, and the projection extends through the through-hole of the grip end portion and projects inwardly of the shaft without contacting an inside surface of the shaft; and wherein the grip body has (1) an annular step portion extending along the overall circumference of an outside edge of the one end of the grip body and having a height and (2) a recess inside the annular step portion for housing therein a base portion of the vibration absorption member, the vibration absorption member being attached to the grip body in such a way that an inner side of the base portion of the vibration absorption member is in abutment against a bottom surface of the recess.

11. A golf club grip comprising:

a grip body including a grip cylinder portion shaped like a cylinder and receiving one end of a cylindrical shaft;

a grip end portion disposed at one end of the grip cylinder portion and formed with a through-hole for communicating a grip interior with the outside; and a vibration absorption member formed from a viscoelastic material admixed with a powdery metal of high specific gravity of 10 or more formed separately from the grip body, and removably attached to the grip body; wherein the grip body has (1) an annular step portion extending along the overall circumference of an outside edge of the one end of the grip body and having a height and (2) a recess inside the annular step portion for housing therein a base portion of the vibration absorption member, the vibration absorption member being attached to the grip body in such a way that an inner side of the base portion of the vibration absorption member is in abutment against a bottom surface of the recess; and the vibration absorption member includes a base portion and a projection formed integrally with the base portion, and the projection extends through the through-hole of the grip end portion and projects inwardly of the grip cylinder portion; and wherein the removable attachment of the vibration absorption member to the grip body is effected by one of the following:

a) an interference fit between the projection and the through-hole;

b) an interference fit between an outer edge surface of the base portion and a confronting inner surface of the annular step portion;

c) a separate member that presses on an outer side of the vibration absorption member;

d) hook and loop fasteners;

e) magnets; and f) a threaded connection between the vibration absorption member and the grip body.

12. A golf club comprising:

a grip body including a cylindrical grip cylinder portion;

a grip end portion disposed at one end of the grip cylinder portion and formed with a though-hole for communicating a grip interior with the outside;

a vibration absorption member formed from a viscoelastic material, admixed with a powdery metal of high specific gravity of 10 or more formed separately from the grip body and removably attached to the grip body;

a cylindrical shaft having one end inserted in the grip cylinder portion; and a golf club head attached to the other end of the shaft; wherein the grip body has (1) an annular step portion extending along the overall circumference of an outside edge of the one end of the grip body and having a height and (2) a recess inside the annular step portion for housing therein a base portion of the vibration absorption member, the vibration absorption member being attached to the grip body in such a way that an inner side of the base portion of the vibration absorption member is in abutment against a bottom surface of the recess; and wherein the vibration absorption member includes a base portion and a projection formed integrally with the base portion, and the projection extends though the through-hole of the grip end portion and projects inwardly of the shaft without contacting an inside surface of the shaft; and wherein the removable attachment of the vibration absorption member to the grip body is effected by one of the following;

g) an interference fit between the projection and the through-hole;

h) an interference fit between an outer edge surface of the base portion and a confronting inner surface of the annular step portion;

i) a separate member that presses on an outer side of the vibration absorption member;

j) hook and loop fasteners;

k) magnets; and l) a threaded connection between the vibration absorption member and the grip body.

* * * * *